US008148653B2

(12) United States Patent
Sattler et al.

(10) Patent No.: US 8,148,653 B2
(45) Date of Patent: Apr. 3, 2012

(54) DOMESTIC APPLIANCE FOR TREATING LAUNDERED ARTICLES, IN PARTICULAR TUMBLE DRYER

(75) Inventors: Guido Sattler, Falkensee (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 427 days.

(21) Appl. No.: 12/513,533

(22) PCT Filed: Oct. 30, 2007

(86) PCT No.: PCT/EP2007/061694

§ 371 (c)(1),
(2), (4) Date: May 5, 2009

(87) PCT Pub. No.: WO2008/055819

PCT Pub. Date: May 15, 2008

(65) Prior Publication Data

US 2010/0066469 A1 Mar. 18, 2010

(30) Foreign Application Priority Data

Nov. 7, 2006 (DE) ..... 10 2006 052 428

(51) Int. Cl.
*H01H 3/16* (2006.01)
*H01H 27/00* (2006.01)

(52) U.S. Cl. ..... 200/43.04; 200/61.62; 335/205

(58) Field of Classification Search ..... 200/61.62, 200/61.7, 61.71, 61.73, 43.01–43.09; 335/205–207; 68/139, 12.16, 12.06, 12.26, 212; 34/534
See application file for complete search history.

(56) References Cited

U.S. PATENT DOCUMENTS

| | | | | |
|---|---|---|---|---|
| 2,748,244 | A * | 5/1956 | Nellis | 219/398 |
| 3,852,692 | A * | 12/1974 | Moorman | 335/205 |
| 4,616,285 | A * | 10/1986 | Sackett | 361/1 |
| 5,541,562 | A * | 7/1996 | Fletcher et al. | 335/205 |
| 5,656,982 | A * | 8/1997 | Kurahara | 335/205 |
| 5,735,007 | A | 4/1998 | Choi | |
| 5,925,861 | A * | 7/1999 | Fromberg | 200/61.67 |
| 5,939,961 | A * | 8/1999 | Fevre | 335/205 |
| 6,603,378 | B1 * | 8/2003 | Collins | 335/205 |
| 6,801,112 | B1 * | 10/2004 | Saxer | 335/205 |
| 7,232,967 | B2 * | 6/2007 | Rupp | 200/61.62 |
| 2004/0134239 | A1 | 7/2004 | Hapke et al. | |
| 2007/0103887 | A1 | 5/2007 | Bleier et al. | |
| 2008/0106105 | A1 | 5/2008 | Spiessl | |
| 2010/0083712 | A1 * | 4/2010 | Lim et al. | 68/139 |

FOREIGN PATENT DOCUMENTS

| | | | |
|---|---|---|---|
| DE | 7737992 | U1 | 6/1978 |
| DE | 3201196 | A1 | 8/1982 |
| DE | 3501538 | A1 | 7/1986 |
| DE | 4034853 | A1 | 5/1992 |

(Continued)

*Primary Examiner* — Michael Friedhofer
(74) *Attorney, Agent, or Firm* — James E. Howard; Andre Pallapies

(57) ABSTRACT

A domestic appliance for treating laundered articles including a container for receiving laundered articles, which can be introduced into the container via a loading opening that can be closed by a door, and a door contact switch that is actuated as a function of a door position in order to interrupt a treatment process of the laundered articles, wherein the door contact switch is arranged on a substrate, which supports electronic control devices of the domestic appliance.

12 Claims, 2 Drawing Sheets

FOREIGN PATENT DOCUMENTS

| | | | | |
|---|---|---|---|---|
| DE | 102005017870 | A1 | | 11/2005 |
| EP | 0384148 | A1 | | 8/1990 |
| EP | 0858768 | A1 | | 8/1998 |
| EP | 1321090 | A2 | | 6/2003 |
| JP | 06-000277 | A | | 1/1994 |
| JP | 08187390 | A | * | 7/1996 |
| JP | 09028980 | A | * | 2/1997 |
| WO | 2006003535 | A1 | | 1/2006 |

* cited by examiner

DOMESTIC APPLIANCE FOR TREATING LAUNDERED ARTICLES, IN PARTICULAR TUMBLE DRYER

The invention relates to a domestic appliance for treating laundered articles, in particular a tumble dryer or a laundry dryer, comprising a container for receiving laundered articles, which can be introduced into the container via a loading opening that can be closed by a door, and a door contact switch, which interrupts the treatment process of the laundered articles as a function of a door position.

BACKGROUND OF THE INVENTION

An essential requirement of known tumble dryers is that opening of the loading door leads to interruption of the drying process during a running treatment process. This is conventionally achieved by a door contact switch which in known tumble dryers is actuated by a mechanical operating pin. This door contact switch is generally secured in the housing of the tumble dryer, close to the door edge.

Tumble dryer designs are also known in which a mechanically actuatable key button is operated by a lever.

One drawback of the known tumble dryer designs lies in the fact that relatively complex assembly of the door contact switch is necessary. This results in additional manufacturing times and assembly costs.

A door lock component is known from DE 77 37 992 U1. This is designed to lock the door of a domestic appliance, which must not be opened during operation, for example of a washing machine, for the given time against inadmissible opening. A switching device and an assembly for detecting different positions of a door element is known from DE 103 55 603 A1, it being possible to use the switching device and assembly in domestic appliances such as fridges and cooking appliances.

SUMMARY OF THE INVENTION

The object of the present invention is to create a domestic appliance for treating laundered articles in which a door contact switch is configured and attached in such a way that assembly effort and assembly costs may be reduced.

This object is achieved by a domestic appliance comprising the features of claim 1.

A domestic appliance according to the invention for treating laundered articles, in particular a tumble dryer or a laundry dryer, comprises a container for receiving laundered articles, which can be introduced into the container via a loading opening. The loading opening can be closed by a door. The domestic appliance also comprises a door contact switch, which can be actuated as a function of a door position, and a treatment process of the laundered articles can be interrupted as a function of actuation of this door contact switch. The door contact switch is arranged on a substrate, which also supports the electronic control devices of the domestic appliance. The integral arrangement of the door contact switch on the substrate means that an assembly can be created which allows reduced assembly effort. Assembly of the door contact switch during manufacture of the appliance is omitted and this door contact switch can already be mechanically fitted on the printed circuit board in a preceding process. Additional assembly costs for contacting of the switch do not apply either.

The door contact switch is preferably constructed as a proximity switch. In particular it may be provided that the door contact switch is constructed as a reed switch. Configuration as a proximity switch allows a door contact switch design which functions very reliably and yet can still be constructed so as to minimize installation space and reduce the number of components.

The proximity switch can be activated by means of an operating pin that is magnetic at least in certain sections. This operating pin preferably comprises a magnetized section on a leading end region.

The operating pin is preferably arranged so as to be movable relative to the proximity switch. The operating pin is preferably arranged on the door for closing the loading opening, whereby the operating pin is also easily moved relative to the door contact switch when this door is moved, and when the door is opened actuates this door contact switch in such a way that a running treatment process of the laundered articles is interrupted.

In addition to the configuration of an operating pin with an integrated magnet, it may also be provided that a magnetic element is arranged adjacent to the proximity switch so as to be positionally stable with respect to this switch, and an operating pin is constructed so as to be ferromagnetic at least in certain sections and is arranged so as to be movable relative to the stationary magnetic element such that the magnetic field of the magnetic element can be affected by the movement of the operating pin. The door contact switch can in turn be actuated by this change in the magnetic field of the magnetic element. A switching operation of the door contact switch can be triggered by weakening or strengthening the magnetic field of the magnetic element.

A development of the domestic appliance according to the invention is also preferred in which a magnetic element is arranged adjacent to the proximity switch so as to be positionally stable with respect to the switch, it being possible to switch the switch by the movement of the magnetic element. This means a special operating pin can be avoided. However it is necessary to configure all components of the domestic appliance, which may come to rest between the magnetic element and the switch, so as to be permeable to the magnetic field produced by the magnet. Options exist in this regard however: in particular appropriate components, for example a door or a front wall, can be made from conventional, non-magnetic plastics material.

It may be provided that the operating pin is separated, in particular insulated, from the substrate, in particular the electronic devices provided thereon, by a plastics material part. This can prevent the electronic devices from being affected by the magnetic field of the operating pin.

The substrate is preferably arranged inside the domestic appliance above the loading opening. It may be provided that the substrate with the electronic devices disposed thereon is arranged on the inner side of a front wall of the domestic appliance. It may likewise also be provided that the substrate is arranged on an inner side of an upper wall of the domestic appliance and is therefore oriented horizontally rather than vertically. This makes it possible to in each case optimally attach the substrate, with the door contact switch arranged thereon, as needed and so as to meet requirements.

The substrate can preferably move in a recess on an edge region adjoining the loading opening as a result of movement of the door relative to the door contact switch.

The opening for insertion of the door contact switch can be constructed as a hollow plastics material part, whereby contact with the switching element may be prevented. This allows a relatively low-wear configuration.

Furthermore, this opening or recess for the operating pin can be constructed so as to be relatively large, so no collision occurs even in the case of relatively large variations in size between the mechanical components, for example owing to a lowered door. The wear can also be significantly reduced thereby.

The development according to the invention allows a relatively large positional tolerance in the movement direction of the door and operating pin, moreover.

The door contact switch is moreover reliably protected against contamination, which could penetrate via the operating pin opening for example. Compared with mechanical door contact switches known from the prior art, in the development according to the invention the switching element can be prevented from being disabled by simple mechanical aids, as in a preferred embodiment a magnet is always required.

A further advantage of the invention can be seen in the fact that costs for a cable assembly, which conventionally leads from the electronic devices of the domestic appliance to the switch and has to be laid in the housing of the domestic appliance, do not apply. Assembly costs can also be reduced in this connection.

BRIEF DESCRIPTION OF THE DRAWINGS

Exemplary embodiments of the invention will be described in more detail hereinafter with reference to schematic drawings, in which.

Identical elements or elements with the same function are provided with the same reference numerals in the figures.

DETAILED DESCRIPTION OF THE EXEMPLARY EMBODIMENTS OF THE PRESENT INVENTION

Figure 1:
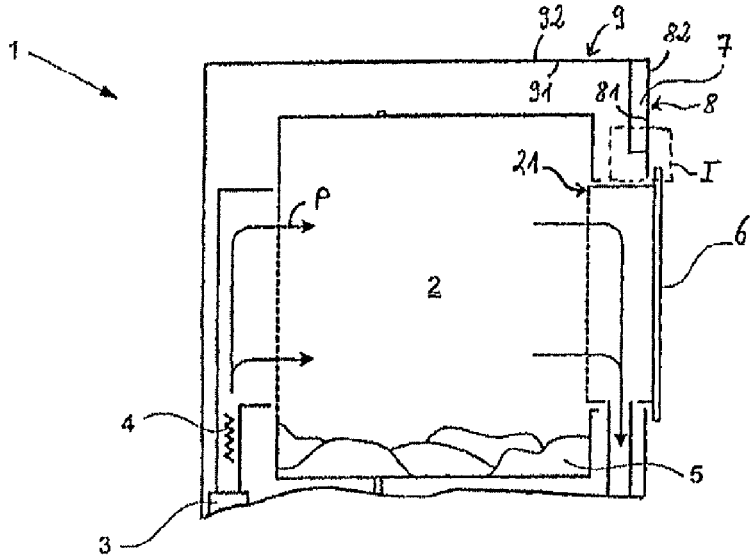
FIG. 1 shows a sectional view through a portion of a domestic appliance for treating laundered articles.

FIG. 1 shows a sectional view of a tumble dryer 1, which comprises a container 2, constructed as a rotatably mounted drum, for receiving laundered articles 5. The laundered articles 5 can be introduced via a loading opening 21 of the container 2. This loading opening 21 can be closed by a door 6.

The view according to FIG. 1 also shows a process air fan 3 and a heating installation 4. During a drying process, process air P is produced by means of the process air fan 3 and flows through the container 2. The process air P can be heated by means of the heating installation. The remaining configuration of the tumble dryer 1 is not shown in more detail and is of secondary importance to the present description. It should be mentioned merely by way of example that a heat pump, in particular a thermoelectric heat pump, may be provided instead of or in addition to this heating installation 4. The tumble dryer 1 can also be constructed as a conventional condensing dryer however.

In the illustrated embodiment a substrate 7 with electronic control devices 7 of the domestic appliance disposed thereon is arranged on an inner side 81 of a front wall 8 of the tumble dryer 1. In this embodiment the substrate 7 is therefore substantially vertically positioned and operating elements (not shown) are arranged on an outer side 82 of the front wall 8.

In a further embodiment it may be provided that this substrate 7 is arranged on an inner side 91 of an upper wall 9 of the tumble dryer 1 and is therefore positioned so as to be substantially horizontally oriented. In this embodiment operating elements are preferably arranged and accessible on an outer side 92 of this upper wall 9.

Figure 2:
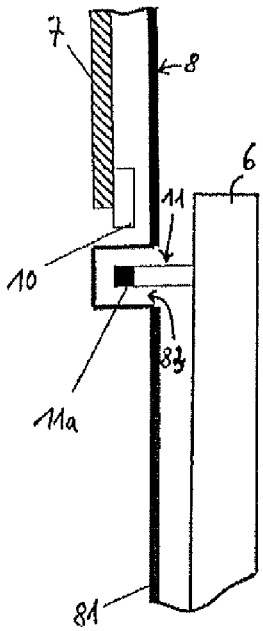
FIG. 2 shows an enlarged view of a portion according to FIG. 1.

An enlarged view of the region I in FIG. 1 is shown in the sectional view in FIG. 2. This schematic view shows the substrate 7 with a door contact switch 10 arranged thereon. This door contact switch 10 is therefore arranged integrated on the substrate 7. An operating pin 11 is secured to the door 6 and on its side facing the front wall 8 comprises a magnet 11*a*. On an edge region, adjoining the loading opening 21, of this front wall 8 there is provided a recess 83 into which the operating pin 11 is introduced when the door 6 is closed. In the exemplary embodiment the door contact switch 10 is constructed as a proximity switch, in particular as a reed switch. This door contact switch 10 is positioned in such a way that it may be actuated as a function of the movement of the operating pin 11. Starting from the view shown in FIG. 2, it may thus be achieved that when the door 6 is opened the operating pin 11, and therefore the magnet 11*a*, are also moved and the door contact switch 10 is actuated due to the change in the magnetic field. A running treatment process, in particular a drying process, of the tumble dryer 1 is then interrupted by the electronic devices arranged on the substrate 7 as a function of this actuation.

Figure 3:
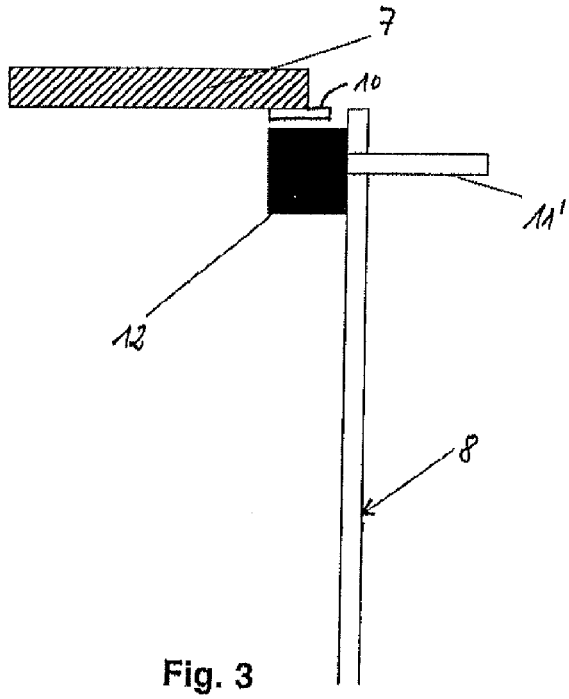
FIG. 3 shows a schematic section of a portion of a domestic appliance according to a second embodiment.
Figure 4:
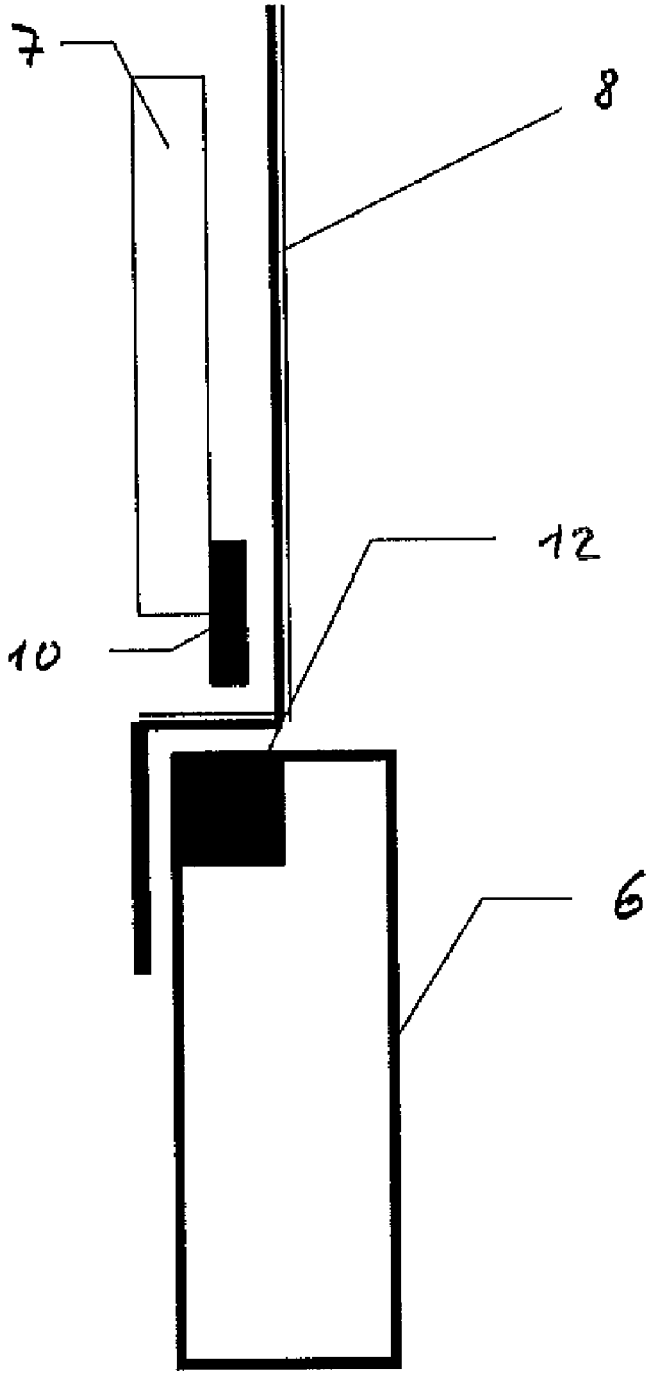
FIG. 4 shows a variant of the exemplary embodiment according to FIG. 2.

FIG. 3 shows in a schematic view a section in which the substrate 7, with the door contact switch 10 arranged thereon, is horizontally oriented and is provided on the inner side 91 of the upper wall 9. Moreover, in this embodiment a magnetic element 12 is stationarily provided on the inner side 81 of the front wall 8 and is therefore arranged so as to be positionally stable with respect to and at a distance from the door contact switch 10. A ferromagnetic operating pin 11' is secured to the door (not shown) and is arranged so as to be movable relative to this magnet 12 and therefore also movable relative to the door contact proximity switch 10. The magnetic field of the magnetic element 12 can be affected by the movement of the operating pin 11' when the door 6 is opened or closed and the door contact switch 10 can be actuated via this change in the magnetic field of the magnetic element 12.

The operating pins 11, 11' can each be electrically insulated by a plastics material part (not shown) from the electronic control devices provided on the substrate 7.

The variant of the exemplary embodiment described with reference to F*ig*. 4 is characterized in that, instead of the pin 11 with magnets 11*a*, there is only one magnet 12 provided in the door 6. If the door 6 is closed then the magnet 12 brings about switching of the door contact switch 10—constructed as a reed switch—which is provided on the substrate 7. In this exemplary embodiment it is necessary for the door 6 and the front wall 8 to be non-magnetic in the vicinity of the door contact switch 10 and magnet 12 in any case in order to allow contact between these components which is imparted via the magnetic field. Specifically, the door 6 and front wall 8 are made from suitable plastics material here.

The invention claimed is:

1. A domestic appliance for treating laundered articles, comprising:

a container for receiving laundered articles, which can be introduced into the container via a loading opening that can be closed by a door; and a door contact switch located adjacent the opening and that is actuated as a function of a door position in order to interrupt a treatment process of the laundered articles, wherein the door contact switch is arranged on a substrate, which supports electronic control devices of the domestic appliance.

2. The domestic appliance as claimed in claim 1, wherein the door contact switch is a proximity switch.

3. The domestic appliance as claimed in claim 2, comprising:

an operating pin, wherein at least one section of the operating pin is magnetic, and wherein the operating pin activates the proximity switch.

4. The domestic appliance as claimed in claim 3, wherein the operating pin is moveable relative to the proximity switch.

5. The domestic appliance as claimed in claim 3, wherein the operating pin includes a magnetized section on a leading end region.

6. The domestic appliance as claimed in claim 3, wherein the substrate is a printed circuit board, and wherein the door contact switch is integrally arranged on the printed circuit board.

7. The domestic appliance as claimed in claim 2, comprising:

a magnetic element arranged adjacent to the proximity switch such that the magnetic element is positionally stable with respect to the switch, and an operating pin that is ferromagnetic at least in certain sections and moveably arranged relative to the magnetic element such that the magnetic field of the magnetic element is changed by a movement of the operating pin.

8. The domestic appliance as claimed in claim 2, comprising: a magnetic element arranged adjacent to the proximity switch such that the magnetic element is positionally stable with respect to the switch and in such a way that the switch is switched by a movement of the magnetic element.

9. The domestic appliance as claimed in claim 2, wherein the substrate is arranged inside the domestic appliance above the loading opening.

10. The domestic appliance as claimed in claim 2, comprising:

a recess in an edge region adjoining the loading opening; and an operating pin in the edge recess, wherein the operating pin is moveable relative to the door contact switch by a movement of the door.

11. The domestic appliance as claimed in claim 1, wherein the door contact switch is a reed switch.

12. A domestic appliance for treating laundered articles, comprising:

a container for receiving laundered articles, which can be introduced into the container via a loading opening that can be closed by a door; and a door contact switch that interrupts a treatment process of the laundered articles based on a movement of the door from a closed position to an open position, wherein the door contact switch is arranged integrally on a printed circuit board of the domestic appliance.

* * * * *